United States Patent [19]

Martin, Jr.

[11] 4,379,418

[45] Apr. 12, 1983

[54] SAFETY BOOT FOR PUNCH OR THE LIKE

[76] Inventor: Robert P. Martin, Jr., c/o Martin Sheet Metal, Inc., 7108 Madison Ave., Cleveland, Ohio 44102

[21] Appl. No.: 231,253

[22] Filed: Feb. 3, 1981

[51] Int. Cl.[3] ..... B26F 1/02; B26D 7/22

[52] U.S. Cl. ..... 83/544; 74/615; 83/560; 83/616; 83/DIG. 1

[58] Field of Search ..... 83/544–546, 83/559, 560, 574, 616, DIG. 1; 74/615, 612

[56] References Cited

U.S. PATENT DOCUMENTS

| | | | |
|---|---|---|---|
| 1,387,553 | 8/1921 | Miller | 83/544 X |
| 2,089,938 | 8/1937 | Bertrand | 74/615 X |
| 2,320,240 | 5/1943 | Janiszewski | 83/544 X |
| 2,350,247 | 5/1944 | Newell | 83/544 X |
| 2,354,291 | 7/1944 | Grover | 74/615 |
| 2,401,800 | 6/1946 | Ryan | 83/544 X |

*Primary Examiner*—Frank T. Yost

*Attorney, Agent, or Firm*—Pearne, Gordon, Sessions, McCoy, Granger & Tilberry

[57] ABSTRACT

A safety boot assembly for use with a press brake operated C-frame punch or the like tool which fits between the ram of the press and the upper arm of the C-frame to prevent a human limb from being inadvertently placed in any gap between the ram and C-frame. The disclosed assembly includes a corrugated boot and end fittings to attach its ends to the ram and C-frame.

9 Claims, 5 Drawing Figures

SAFETY BOOT FOR PUNCH OR THE LIKE

BACKGROUND OF THE INVENTION

The invention relates to safety appliances for power-operated machinery, and in particular to a device for protecting persons in the use of press brake operated C-frame punches and the like.

PRIOR ART

It is customary to extend the usefulness of a press brake by temporarily converting it to perform punching and stamping operations. This is accomplished by provisionally installing one or more C-frame punches on the bed of the brake press. The C-frame punches and like tools are energized by the press brake ram, which typically engages an operator pin on an upper jaw of the C-frame disposed in the path of the ram. Operator pins on the C-frame punches ordinarily have a stroke substantially less than the full stroke of the ram so that in their respective idle positions, there is a space between the ram and operator pin. The prior art practice of installing C-frame punches on a press brake as described presents a danger that the limb of a person operating the press, a helper, or bystander will inadvertently be caught and suffer injury between the ram and operator pin during closing movement of the ram.

SUMMARY OF THE INVENTION

The invention provides a safety boot appliance for use with press brake-operated C-frame implements which employs a collapsible boot to exclude the limbs of a person in the work area. The boot is disposed between the press brake ram and upper jaw of the C-frame, and collapses under the advance of the ram. As disclosed, the boot is collapsible in the manner of a bellows to accommodate the relative motion of the ram and C-frame during movement of the ram before and after it contacts the operator element on the C-frame. The boot has sufficient lateral stiffness to prevent it from being displaced sideways, as when a person inadvertently might come in contact with it such as by leaning or resting against it with a limb.

In the disclosed embodiment, the boot is provided with fittings at its opposite ends, one adapted to engage the ram and the other adapted to be secured to the upper C-frame jaw. The boot in its illustrated form has a circular cross section and is conveniently fabricated from wire-reinforced corrugated hose stock. The combined strength and resiliency of the hose fabric and wire reinforcement is sufficient to provide lateral resistance to any moderate side loads which could be developed by a person inadvertently resting a hand or arm against it. The circumferential corrugations of the boot accommodate a high degree of resilient axial compression to take up the stroke of the press brake.

As disclosed, the end fittings may be cup-shaped and require simple insertion of the ends of the boot therein to effect an assembly. The upper end fitting can be simply retained in position against the lower face of the ram by precompression force in the boot. This precompression is developed by sizing the free length of the boot to a dimension somewhat greater than that existing between the ram and upper jaw of the C-frame.

The lower boot fitting, in the disclosed embodiment, includes a mounting tab having a hole which is alignable with a slot ordinarily provided in the upper jaw so that a bolt through these apertures can be used to secure the lower fitting to the C-frame. The lower fitting can be left on the C-frame indefinitely and does not significantly interfere with access or inspection of the tools on the C-frame. With the lower fitting once bolted or otherwise secured to the C-frame, additional setup and knockdown time for the safety boot assembly is minimal if not insignificant, since no tools or involved manipulation of the elements are required for such activity.

DESCRIPTION OF THE PREFERRED EMBODIMENT

Figure 5:
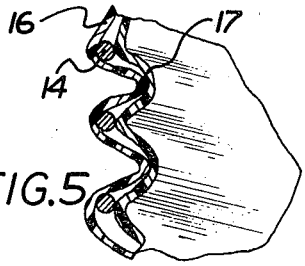
FIG. 5 is a fragmentary, cross-sectional view through the wall of the safety boot illustrating constructional details thereof.

Referring now to the drawing, there is illustrated a safety boot assembly 10 which comprises a boot 11 and a pair of cup-shaped fittings 12, 13 at each end of the boot. The boot 11, in the form of a bellows-like sleeve in the illustrated example, is fabricated from flexible, corrugated, round hose stock by cutting such stock to a suitable length. The hose stock is preferably of a commercially available type which includes a circumferential reinforcing wire 14 that, in its free state, assumes an open helical configuration. As indicated in FIG. 5, the reinforcement wire 14 is sandwiched between laminated plies 16, 17 of fabric making up the wall of the boot 11. As indicated the wall has a generally circumferential corrugation associated with each course of the wire 14.

The lower end fitting 12 includes a cylindrical sidewall 21 with an inside diameter sized to closely fit the outside diameter of the boot 11. An end wall 22 of the fitting 12 has a relatively large, centrally disposed aperture 23. The end wall 22 includes a generally triangular tab 24 having a mounting hole 25 near its apex. The upper end fitting 13 is a relatively shallow cup-shaped structure having a circular end wall 27 and a short, cylindrical sidewall 28. The inside diameter of the sidewall 28 closely fits the outside diameter of the boot 11. On the side of the end wall 27 opposite the sidewall 28 a pair of parallel tabs 29 form a channel with the end wall. The end fittings 12, 13 are fabricated of any suitable rigid material, such as steel, aluminum, or a plastic material such a polyvinylchloride, polyethylene, nylon, and the like.

Figure 1:
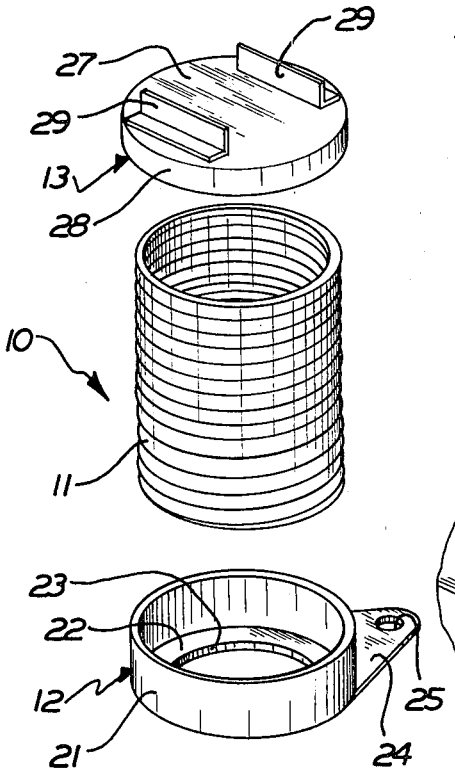
FIG. 1 is an axially exploded, perspective view of a safety boot assembly constructed in accordance with the invention.
Figure 2:
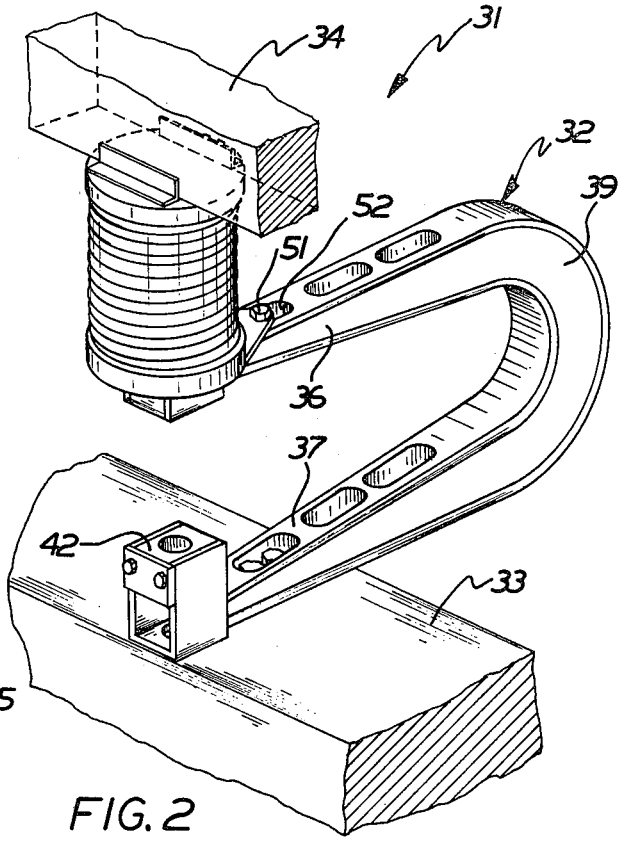
FIG. 2 is a perspective view of the safety boot assembly installed in the gap between the ram of a press brake and the upper jaw of a C-frame tool.

The safety boot assembly 10 is adapted to be used in conjunction with a press brake 31 and a C-frame punch 32, such as illustrated in FIG. 2. The press brake 31 is schematically represented by a fixed bed 33 and a movable ram 34, both partially illustrated in FIG. 2. The press brake 31 is typical of commercial units used in the metal fabrication industry. The press brake 31 is tripped by a human operator to vertically reciprocate the ram 34 through a cycle towards and away from the bed 33.

The C-frame punch assembly is typical of commercially available units which are employed separately or in multiples as an accessory on the press brake 31. The C-frame assembly includes a pair of horizontally extending jaws 36, 37 vertically spaced to form a working gap 38. The rear portions of the jaws 36, 37 are joined with an integral web 39.

Figure 3:
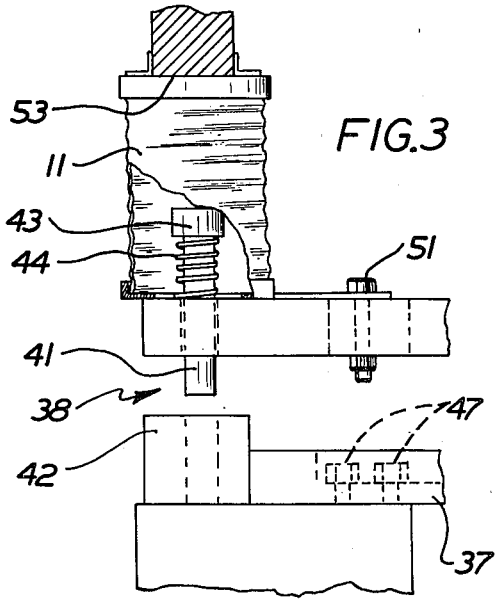
FIG. 3 is a side elevational view of the safety boot assembly, with portions broken away to reveal details of its association with the C-frame tool.

At their free ends, the C-frame jaws 36, 37 support in working alignment complementary tools, such as a circular punch and a circular die 41, 42. An operator pin 43 biased by a spring 44 to a return position illustrated in FIG. 3 is adapted to drive the punch 41 against the die 42, and thereby perforate or otherwise operate on flat stock material such as sheet steel inserted in the working gap 38 between the jaws 36, 37. In a conventional manner, the C-frame punch assembly 32 is temporarily fixed to the press brake bed 33 by suitable, tie-down bolts 47. In this fixed position, the operator pin 43 is disposed in the path of the ram 34. As suggested in FIG. 4, the ram 34 is operated so that at its lowermost point, the punch 41, driven by the ram through the pin 43, is moved into full working relationship with the die 42.

The safety boot assembly 10 is installed between the press brake ram 34 and C-frame punch assembly 32 by bolting the lower end fitting 12 to the upper C-frame jaw 36 by means of a bolt or like fastener 51 extending through the tab aperture 25 and a slot 52 extending through the upper jaw. The central aperture 23 in the end wall 22 of the lower fitting 12 assures that the operator pin 43 and spring 44 can extend through this fitting with adequate clearance. The upper end fitting 13 is slipped under a lower face 53 of the ram 34, with the tabs 29 straddling its thickness, and the boot 11 is slipped into both of the end fittings 12, 13. Ideally, the free length of the boot 11 is somewhat greater than the maximum distance between the fitting end walls 22, 27 so that a slight axial precompression in the boot will maintain the upper end fitting 13 in contact with the ram 34. Alternatively, or to augment the retaining force of the boot 11, the tabs 10 may include means, such as screws or spring clips, to releasably grip the ram 34.

The stroke of the ram 34 is ordinarily substantially greater than the stroke of the operator pin 43 and associated punch 41, so that when the ram is at rest a gap exists between the ram and operating pin. This gap may present a trap for the unwary operator or nearby observer, who may inadvertently introduce or rest a limb in the area of this gap and be unable to respond quickly enough to withdraw it when the ram is 34 tripped. The safety boot assembly 10 avoids this potential risk by preventing the inadvertent introduction of human limbs and other objects, for that matter, into this gap.

Figure 4:
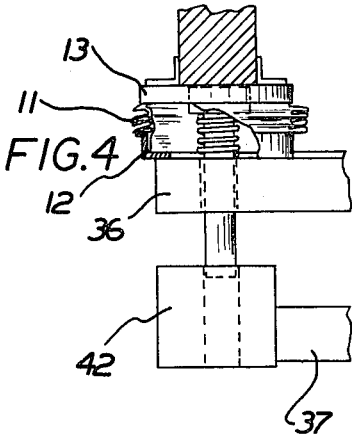
FIG. 4 is a fragmentary view similar to FIG. 3, illustrating the ram in its downwardly extended position and the safety boot in an axially compressed state.

The boot fabric material 16, 17 and the reinforcement wire 14 have sufficient elasticity to be axially compressed from the rest position of FIG. 3 to the fully compressed position imposed by the ram and then returned to the rest position without permanent deformation. As indicated in FIG. 4, the axial compression of the boot fabric is permitted by the corrugated nature of the wall of the boot 11. The combined stiffness of the fabric 16, 17 and spring reinforcement wire 14 making up the boot 11 is selected to provide a relatively high level of resistance to lateral deflection. This resistance greatly reduces the risk that a person could inadvertently position a limb in the gap between the ram 34 and operating pin 43.

It will be understood by those skilled in the art that the invention has many advantages which include simplicity, minimal tooling, material and labor costs in its manufacture, and ease of installation. The boot 11 and upper end fitting 13 can be readily removed without tools for inspection of the operating pin area. When the C-frame assembly 32 is knocked down, i.e., removed from the bed 33 of the press brake 31, the lower end fitting 12 need not be removed from the C-frame assembly 32, but rather may be stored with the C-frame assembly. When the upper fitting 13 is made of relatively soft material, such as plastic, a clearance hole may be provided in the center of its end wall 27 so that the force of the ram 34 is applied directly to the operator pin 43.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In combination, a press brake having a bed and a ram movable vertically in a stroke cycle towards and away from the ram, a C-frame assembly removably secured to the bed of the press brake, said C-frame having a pair of generally horizontal jaws vertically spaced from one another, the free ends of the jaws being adapted to support a pair of tool elements in working alignment, operator means on an upper one of said jaws and disposed in the path of said ram, said operator means being forcibly displaced by said ram to cause said tool elements to cooperate in working a workpiece disposed between said jaws, said operator means being constructed and arranged to be contacted by the ram through a final portion of its forward stroke such that a gap exists between the ram and operator means during the initial part of the forward stroke of the ram, and safety shield means extending between said ram and said operator means, said safety shield means being capable of excluding inadvertent positioning of an operator's limb in said gap, said safety shield means including fittings at its upper and lower ends, an upper end fitting including means to laterally stabilize the sleeve by engaging said ram, a lower end fitting including means to engage the upper jaw of said C-frame, both of said engaging means allowing said sleeve to be laterally stabilized by both said ram and said C-frame, said safety shield means, including said lower end fitting, being constructed and arranged to leave the space between said jaws unobstructed through the full stroke cycle of the ram.

2. The combination as set forth in claim 1, wherein said safety shield means includes means permitting it to collapse on an axis parallel to the direction of movement of the ram during the initial portion of the forward stroke of the ram.

3. The combination as set forth in claim 1, wherein said safety shield means comprises a vertically extending sleeve.

4. The combination as set forth in claim 3, wherein said sleeve is circumferentially corrugated to permit said sleeve to collapse axially during the initial portion of the forward stroke of the ram.

5. In combination, a press brake, an accessory C-frame tool provisionally mounted on the bed of the press brake, the press brake having a ram capable of reciprocating movement in a vertical plane through a stroke towards and away from the bed, the C-frame tool including a pair of jaws extending generally horizontally from a web integral therebetween forwardly through a space between the bed and ram and the plane of ram reciprocation, said jaws each being adapted to support one of a pair of cooperating tool elements in working alignment, an operator pin on an upper one of said jaws in the path of said ram, the ram being spaced from the operator pin when remote from said bed, a safety boot assembly extending between said ram and said C-frame tool, said safety boot assembly including a circumferentially corrugated sleeve of resilient material and fittings at opposite ends thereof, an upper one of said fittings including means to embrace said ram, a lower one of said fittings including means to facilitate mounting thereof to said upper jaw, the combined axial lengths of said corrugated sleeve and said end fittings being arranged to extend between said ram and said operating pin when said ram is in an uppermost position with respect to said bed.

6. A safety boot assembly for sealing the gap between the lead face of the ram of a press brake and a C-frame tool removably supported on the bed of the press brake, comprising a circumferentially corrugated sleeve, means on an upper end of said sleeve for engaging the lead face of the press brake, and means on the lower end of the sleeve for engaging a surface associated with an upper jaw of the C-frame, said engaging means each being stabilized by respective areas of the ram and C-frame tool and in turn laterally stabilizing the sleeve to prevent inadvertent introduction of an operator's limb in a gap between the ram and C-frame tool existing when the ram is in an idle position, said engaging means and sleeve permitting, upon axial compression of said sleeve, said ram to forcibly displace an operator element on the upper jaw of said C-frame to cause tool elements mounted on said jaws to cooperate to work a workpiece disposed between said jaws.

7. A safety boot assembly as set forth in claim 6, wherein said sleeve is a generally circular member.

8. A safety boot assembly as set forth in claim 7, wherein said ram and C-frame engaging elements include cup-shaped formations adapted to receive respective end portions of said circular sleeve member.

9. A safety boot assembly as set forth in claim 8, wherein said C-frame engaging element includes a centrally disposed aperture permitting said operator element to extend therethrough.

* * * * *